US008678953B2

(12) United States Patent
Spencer, Jr. et al.

(10) Patent No.: US 8,678,953 B2
(45) Date of Patent: Mar. 25, 2014

(54) RECONFIGURABLE GOLF BALL STRUCTURAL TEE SYSTEM AND METHOD TO SUPPORT A STATIONARY GOLF BALL

(75) Inventors: Richard A. Spencer, Jr., Ransomville, NY (US); Andrew R. Spriegel, Massillon, OH (US)

(73) Assignee: Mytee Golf Products, LLC, Hudson, OH (US)

( * ) Notice: Subject to any disclaimer, the term of this patent is extended or adjusted under 35 U.S.C. 154(b) by 512 days.

(21) Appl. No.: 12/868,703

(22) Filed: Aug. 25, 2010

(65) Prior Publication Data

US 2011/0065532 A1 Mar. 17, 2011

Related U.S. Application Data

(60) Provisional application No. 61/275,074, filed on Aug. 25, 2009.

(51) Int. Cl.
*A63B 57/00* (2006.01)

(52) U.S. Cl.
USPC ..... 473/389

(58) Field of Classification Search
USPC ..... 473/389
See application file for complete search history.

(56) References Cited

U.S. PATENT DOCUMENTS

| | | | | | |
|---|---|---|---|---|---|
| 2,153,260 | A | * | 4/1939 | Mayl | 473/389 |
| 2,456,511 | A | * | 12/1948 | Isserstedt | 473/389 |
| 2,809,839 | A | * | 10/1957 | Overbaugh | 473/389 |
| 2,930,615 | A | * | 3/1960 | Cowan | 473/388 |
| 3,063,722 | A | * | 11/1962 | Overbaugh | 473/389 |
| 3,863,920 | A | * | 2/1975 | Tassone et al. | 473/417 |
| 6,139,449 | A | * | 10/2000 | Cardarelli | 473/387 |

* cited by examiner

*Primary Examiner* — Gene Kim
*Assistant Examiner* — Amir Klayman
(74) *Attorney, Agent, or Firm* — Spriegel & Associates, LLC

(57) ABSTRACT

A golf tee system comprising a card stock having a thickness, a width, a length with bend lines and break lines formed on the card stock, a tee element formed within the card stock, wherein the card stock is approximately flat and configured to allow at least one tee element to be removed from the card stock and assembled into a structural tee device for holding a golf ball, a top portion, a bottom portion, a body portion connected to and extending upward from the bottom portion, having a first side wall and a second side wall, wherein the first side wall and a second side wall when folded toward each other at least partially bound and define an inner cavity within the body portion, wherein a folded upper crown of the top portion defines a ball receipt surface configured to receive and hold the golf ball off of a ground surface and wherein the reconfigurable golf tee is detached from scored card stock.

12 Claims, 14 Drawing Sheets

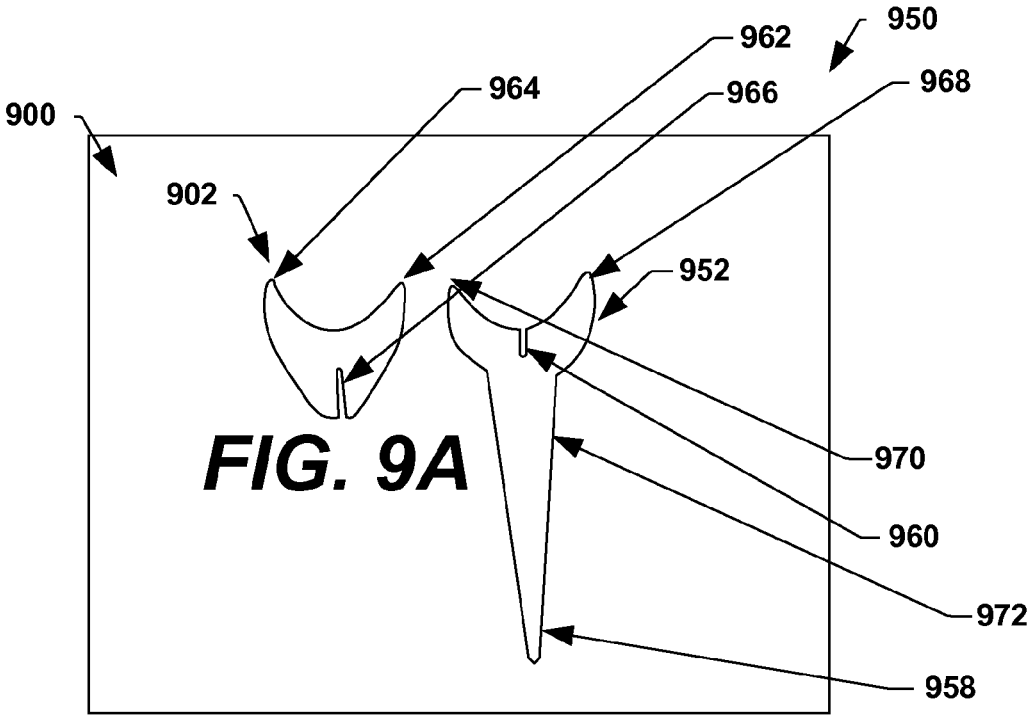
FIG. 9A
FIG. 9B
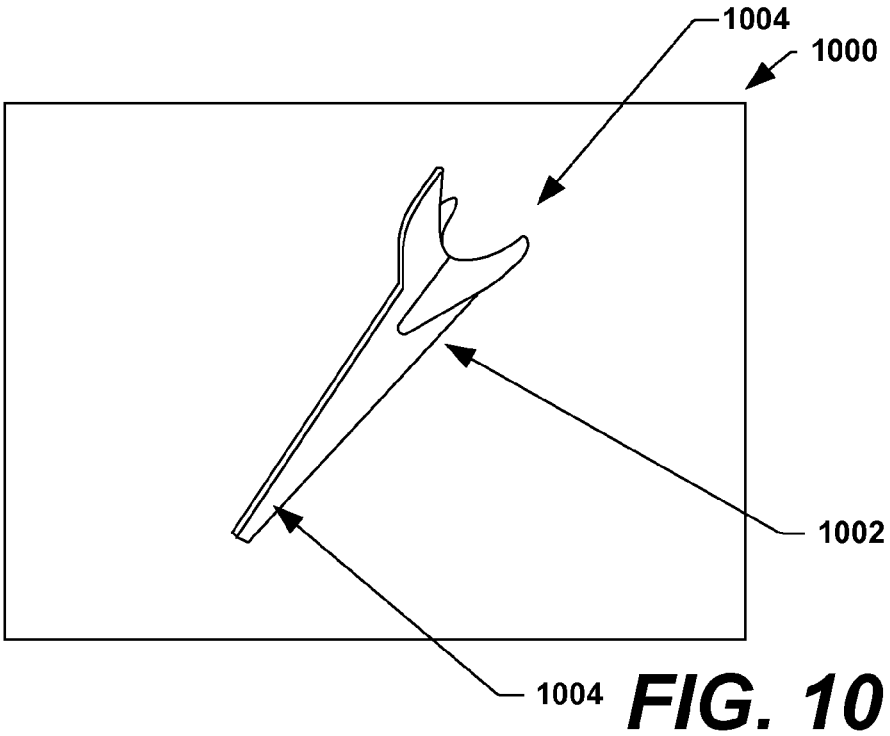
FIG. 10

RECONFIGURABLE GOLF BALL STRUCTURAL TEE SYSTEM AND METHOD TO SUPPORT A STATIONARY GOLF BALL

REFERENCE TO RELATED APPLICATION

This application claims priority to and the benefit of U.S. Provisional Application Ser. No. 61/275,074 which was filed Aug. 25, 2009, entitled RECONFIGURABLE GOLF BALL STRUCTURAL TEE SYSTEM AND METHOD TO SUPPORT A STATIONARY GOLF BALL, the entirety of which is hereby incorporated by reference as if fully set forth herein.

FIELD OF INVENTION

The present invention relates generally to a golf ball structural support system and method and more particularly to a reconfigurable golf ball structural tee system and method wherein the reconfigurable golf ball structural tee is formed in a flat card stock and is reconfigured to support a stationary golf ball.

BACKGROUND OF THE INVENTION

Golf tees are generally well known. They are made from wood, rubber and metal. Normally, they are formed from a single material and have an upper concave surface for supporting the golf ball and a tapered shank with a pointed surface at the base of the golf tee for penetrating the ground, for example. Numerous wooden golf tees are broken and/or lost while playing golf. In addition, golf tees are often stored in a golf bag pocket and the golf tees can take up substantial room due to their haphazard position in the golf bag pocket. Also, tees can be used for advertising except that to have one line of lettering imprinted on a tee is very limited, for example. In addition, if a player runs out of tees in their golf bag it can be a large inconvenience.

Therefore, a need exists for golf tees that are easier to store, that can be used for wider advertising than conventional tees, that can be stored in a wallet, pocket or golf bag and tees that are more durable than conventional wooden tees.

SUMMARY OF THE INVENTION

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to the more detailed description that is presented later.

The invention is directed to a reconfigurable golf tee that is formed within a flat card stock, wherein the flat card stock is configured to accept advertising such as lettering, logos, and the like. Various forms of the reconfigurable tees are also provided, along with releasable means for detaching the tee from the card stock.

It is additional embodiment of the present to provide a tee element that provides less resistance and a lower mass that a typical tee and therefore allows a golf ball to be driven further of the tee element than a typical tee.

It is therefore an object of this invention to provide at least one tee element on a flat card stock which can be reconfigured to hold a stationary golf ball off of a ground surface.

It is another object of this invention to provide a flat card stock which is easily manufactured and easily attached, for example to golf equipment comprising a golf bag, a golf cart and stored in a wallet.

It is yet another embodiment of the present invention to provide a flat card stock with at least one tee element which displays an advertisement comprising a business card, a magnetic strip gift card, a display card, and the like.

In accordance with these and other objects which will become apparent hereinafter, the instant invention will now be described with reference to the accompanying drawings.

BRIEF DESCRIPTION OF THE DRAWINGS

FIGS. 9A, 9B and 10 are figures of a dovetail tee assembly as may be assembled and used in accordance with one or more aspects of the present invention;

DETAILED DESCRIPTION OF THE INVENTION

Figure 1:
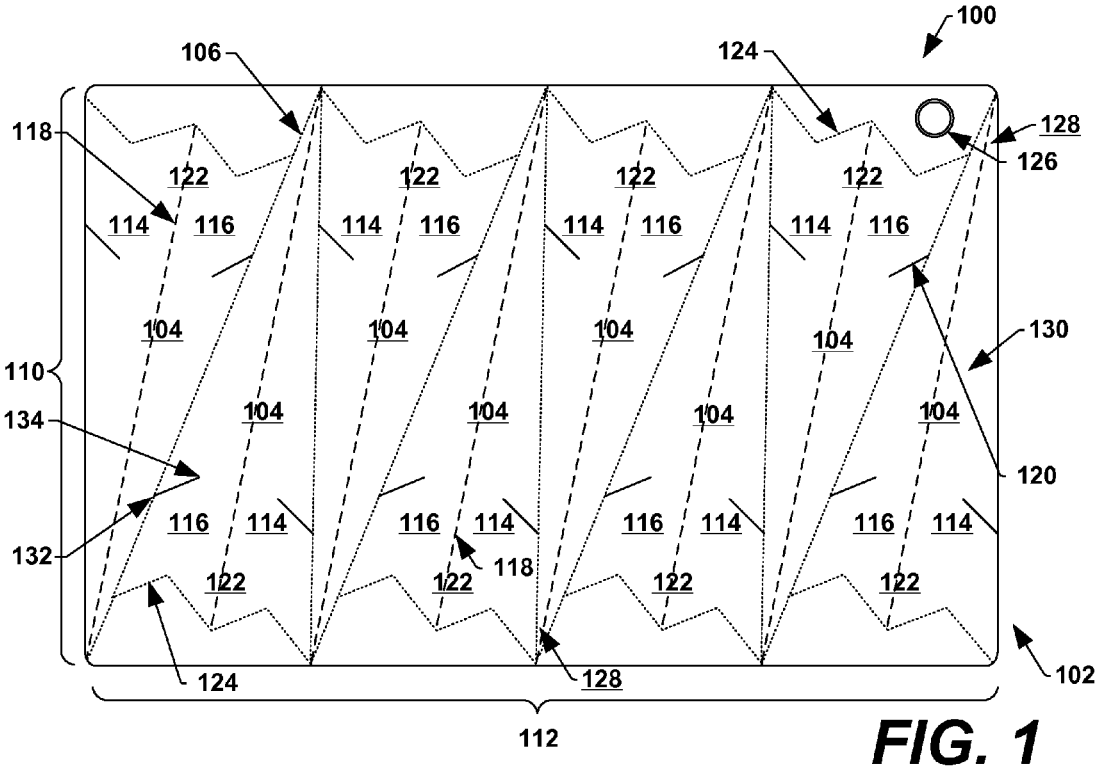
FIG. 1 is a front view of a golf tee system 100 formed on card stock in accordance with a preferred embodiment of the present invention.

The present invention will now be described with reference to the attached drawings, wherein like reference numerals are used to refer to like elements throughout.

FIG. 1 illustrates an embodiment of an exemplary golf tee system 100 used in accordance with at least one aspect of the present invention. FIG. 1 illustrates several advantages of the present invention, the golf tee system 100 over the prior art discussed supra. The preferred embodiment of the golf tee system 100 comprises a card stock or material 102 with at least one tee element 104 non-fixedly attached to, formed within a part of the card stock 102 and configured to be removable from the card stock 102 by bending the at least one tee element 104 along a defined break line 106 until the break line 106 holding the at least one tee element 104 to the card stock 102 is detached. The bend lines are formed so that the card stock will not break when bent over the maximum distance possible. The at least one tee element 104 can be bent and/or folded into a structural shape by bending the at least one tee element 104 along a defined bend line 118. The defined break line 106 and/or the defined bend line 118 can be formed using techniques comprising laser, laser cutting, die cutting, cutting perforations in the card stock 102 and creasing the card stock 102, for example. The techniques of forming the defined bend line 118 and/or the defined break line 106 in the card stock 102 are well known by those of ordinary skill in the art. In one embodiment, the card stock 102 can take the shape of a credit card where a thickness of the card stock 102 can be approximately about 10 to 70 mils, a width 110 of approximately about 2 inches and a length 112 of approximately about 3 inches. In this embodiment the at least one tee element 104 has through slots 120 configured to form a crown area 122 of the at least one tee element 104. In addition the least one tee element 104 can have a minimum thickness as long as it will structurally hold the golf ball. The crown area 122 is approximately the area of the at least one tee element 104 between the crown area top edge 124 and the top of the through slot 120, for example. In this embodiment the slots 120 are, for example, using techniques comprising laser cutting and die cutting, for example, all the way through the card stock 102. However, the through slots 120 can be perforated cuts or not a complete through cut, for example.

The at least one tee element 104 comprises at least one tee element first side 114 and at least one tee element second side 116 configured on opposite sides of the defined bend line 118 from the top of the crown area 122 to the end of a bottom portion 128. The at least one tee element 104 is folded in half so that the at least one tee element first side 114 and the at least one tee element second side 116 come in close proximity to each other, at a location perpendicular to and away from the defined bend line 118. A body portion 130 of the least one tee element 104 is approximately located in the center of the at least one tee element 104. A bottom portion 128 is located approximately in the bottom area of the at least one tee element 104. The bottom portion 128 can be shaped as a point, a tip, and the like for insertion into the ground.

The card stock 102 shown in FIG. 1 is blank; however the card stock 102 can be printed with artwork comprising logos and/or lettering on one side of the card stock 102. In addition, the cardstock 102 can be printed with artwork and/or lettering on both sides of the card stock 102. The artwork and/or lettering can be black and white, grayscale or colored. A through hole 126 can optionally be made in the card stock 102 for a key chain, a strap and the like. The through hole 126 allows the card stock 102 to be attached equipment comprising golf bag or golf cart, for example.

Although the card stock 102 is illustrated in the form of a credit card however, the card stock can take any shape comprising an animal, a club head, a company name, etc. In addition, although the tee elements are shown as symmetrical and the tees are similar in shape, the tees can be non-symmetrical and tees of dissimilar shape can be formed on the same card stock.

Figure 2:
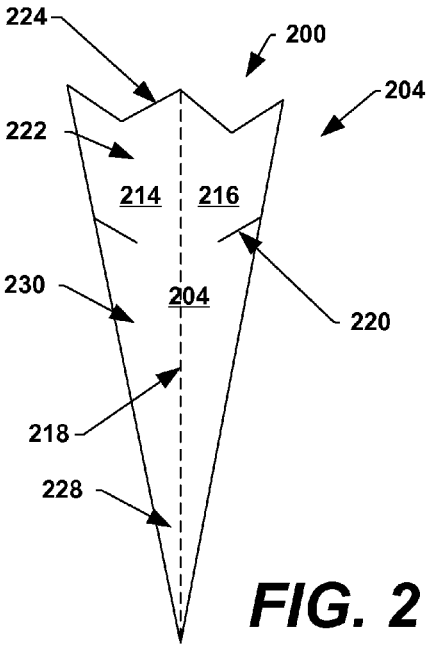
FIG. 2 is a front view of an exemplary tee element 200 removed from the card stock used in accordance with one or more aspects of the present invention for holding a stationary golf ball above the ground in accordance with a preferred embodiment.
Figure 3:
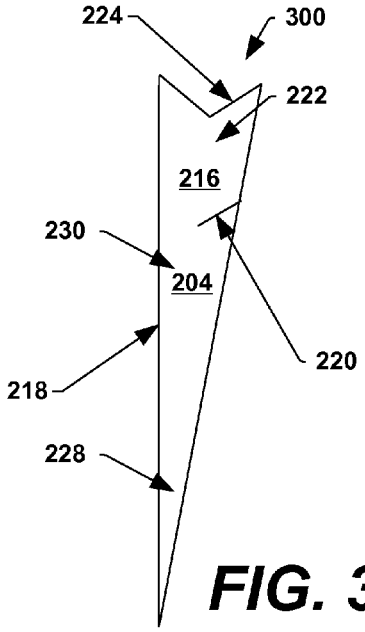
FIG. 3 is a front view of the exemplary tee element illustrated in FIG. 2 wherein the tee element is folded in half, in accordance with a preferred embodiment of the present invention.

Illustrated in FIG. 2 is a tee element 204 removed from a card stock (not shown). In embodiment 200 of the invention, the tee element 204 comprises a tee element first side 214, a tee element second side 216 and slots 220 that pass through the tee element 204. The tee element 204 is configured so that the element first and second halves, 214 and 216 respectively, can be folded along a defined bend line 218 so that the tee element 204 is folded in half as illustrated in FIG. 3. A crown area 222 is approximately the upper portion of the tee element 204 between the slots 220 and a crown area top edge 224. A body portion 230 of the least one tee element 104 is approximately located in the center of the at least one tee element 104. A bottom portion 228 is located approximately in the bottom area of the at least one tee element 204. In FIG. 3, for example, the first side wall 214 (not shown) and the second side wall 216 are folded toward each other.

Figure 4:
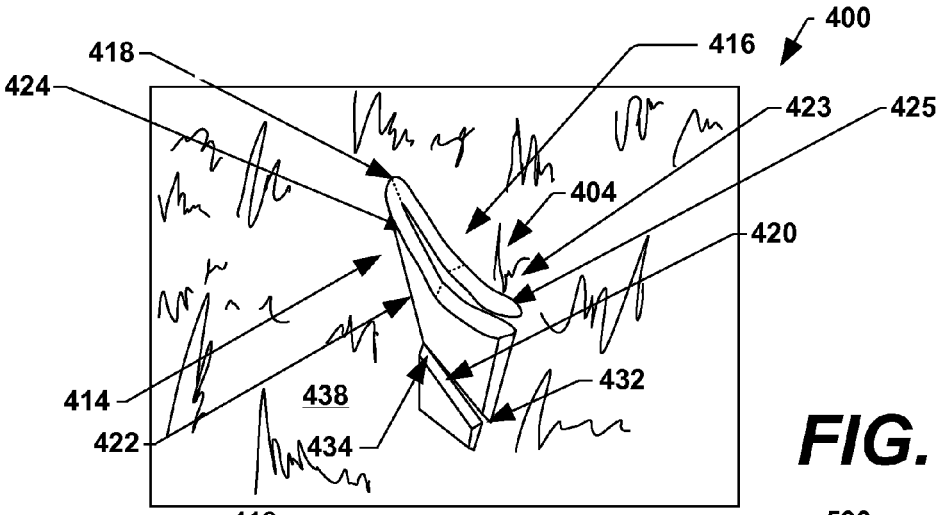
FIG. 4 is a perspective view illustrating an exemplary tee element 400, similar to the tee element 300 shown in FIG. 3 used in accordance with one or more aspects of the present invention wherein the tee element 400 is folded in half and inserted into the ground to hold a stationary golf ball in an elevated position according to one or more aspects of the present invention.

In another embodiment 400 illustrated in FIG. 4, a bend line 418 comprises a crease or perforations, for example, that allows the tee element 404 to be folded in half along the bend line 418 and inserted into a ground surface 438. Initially, when the tee element 404 is removed from a card stock, both a tee element first side 414 and a tee element second side 416 are lying on a single plane. FIG. 4 illustrates the tee element 404 wherein the first side 414 and the second side 416 are folded toward and in contact with each other prior to insertion into the ground surface 438.

A crown area 422 of the tee element 404 is approximately the area of the first side 414 and the second side 416 between the crown area top edge 424 and the top of slots 420, for example. In this embodiment the slots 420 are, for example, laser cut or die cut, for example, all the way through the card stock. However, the slots 120 could be perforated cuts or not a complete through cut. A slot end 434 prevents the crown area 422 of the tee element first side 414 and a tee element second side 416 from being spread apart further without tearing the slot end 434. As the first side 414 and second side 416 are spread apart a tee element first side slot beginning 432 and a tee element second side slot beginning 533 (FIG. 5), are moved further apart.

Figure 5:
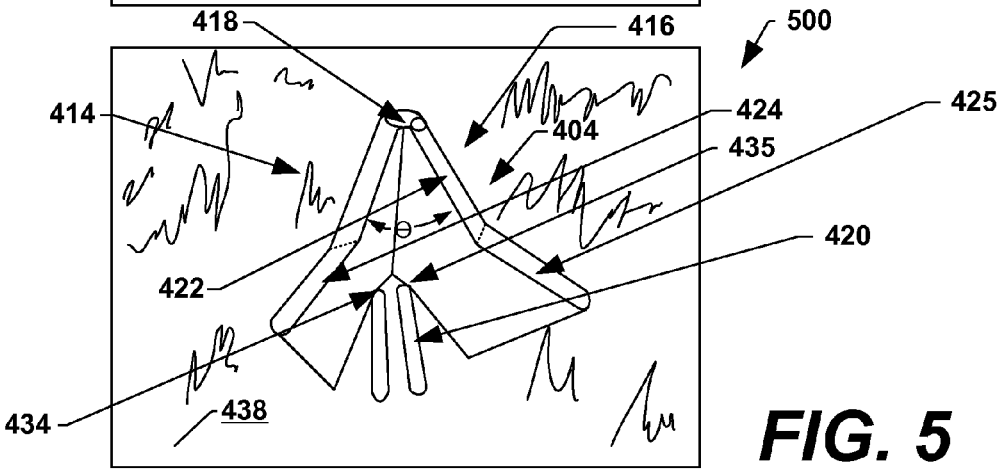
FIG. 5 is a perspective view illustrating an exemplary tee element 500 used in accordance with one or more aspects of the present invention for supporting a stationary golf ball above the ground.

Now referring to FIG. 5, the crown area 422 of the first side 414 and the second side 416 of the tee element 404 of FIG. 4 is spread apart starting from spreading the crown area 422 by separating the tee element first side slot beginning 432 (FIG. 4) away from the tee element second side slot beginning (not shown in FIG. 4). The tee element 404, for example is opened at an angle θ wherein the tee element first side slot end 434 and the tee element second side slot end 435 prevents the crown area first side 422 and the crown area second side 423 from being spread further apart without tearing the slot ends 434 and 435. The angle θ between a tee element first side 414 and a tee element second side 416 is approximately 10 to 40 degrees. The angle θ allows the tee element 404 to support a golf ball on the crown area first side top edge 424 the crown area second side top edge 425. Of course, those skilled in the art will recognize many modifications that may be made to this configuration, without departing from the scope or spirit of what is described herein.

Figure 6:
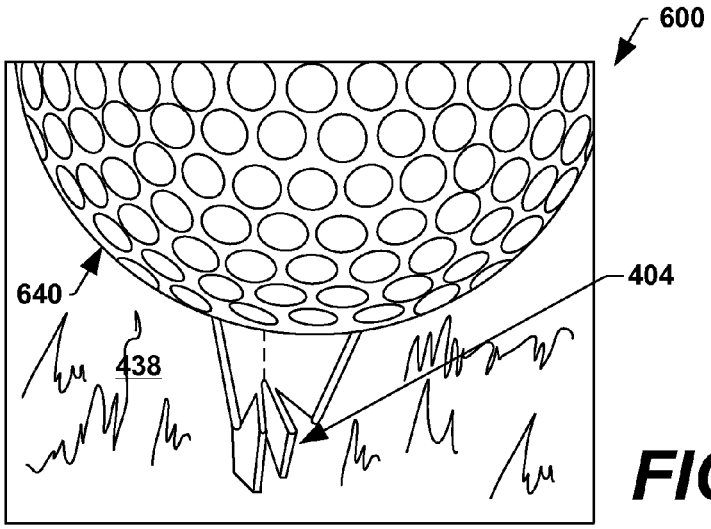
FIG. 6 is a figure illustrating an exemplary tee element 600 supporting a stationary golf ball in accordance with one or more aspects of the present invention.

FIG. 6 is a photograph of the tee element 404 illustrated in FIG. 4 wherein the tee element 404 inserted into the ground surface 438 is configured to support a stationary golf ball 640. The inventors appreciate as do those of ordinary skill in the art that many configurations of the tee element are possible comprising various shapes, sizes, thickness, lengths, widths, numbers of slots, etc. and reconfigurations of the tee element (e.g., rounded, triangular, square, etc.), are possible both symmetrical and non-symmetrical to result in a structure that will support a stationary golf ball. All such structures and configurations are contemplated herein. The inventors recognized that by providing a lighter mass tee element and the tee element was struck with a club head the tee element would bend over would result in greater distance than a typical plastic or wood golf tee.

Figure 7:
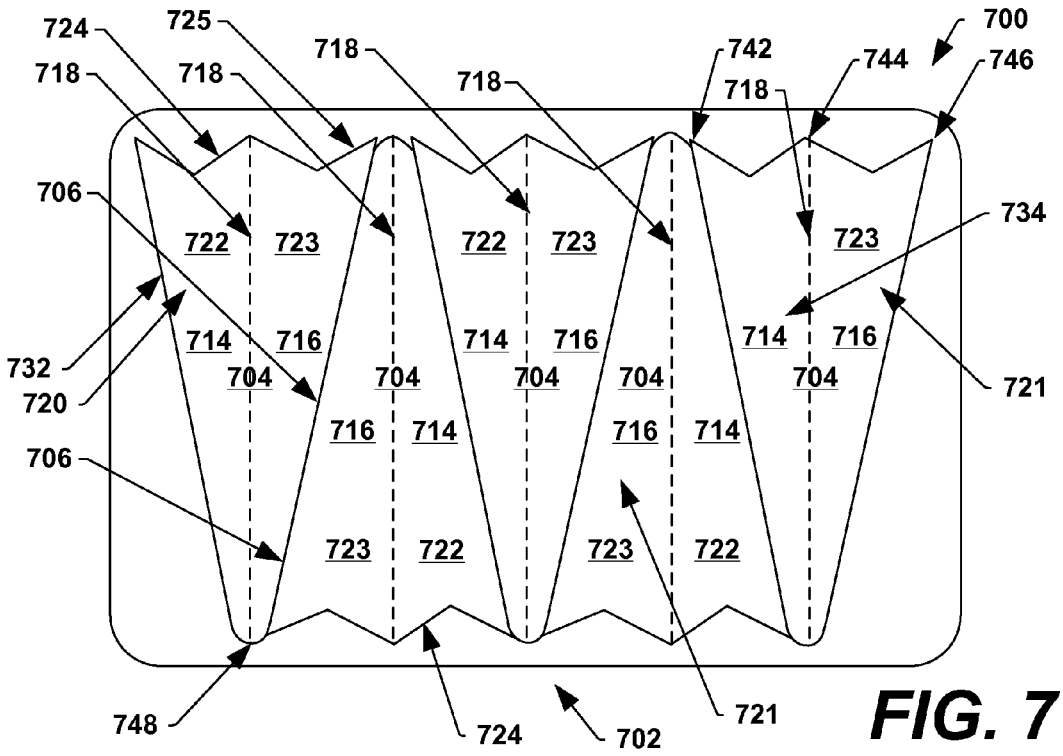
FIG. 7 is a front view of yet other embodiment of a golf tee system 700 illustrating at least one tee element formed in a card stock such as may be used in accordance with one or more aspects of the present invention.
Figure 8:
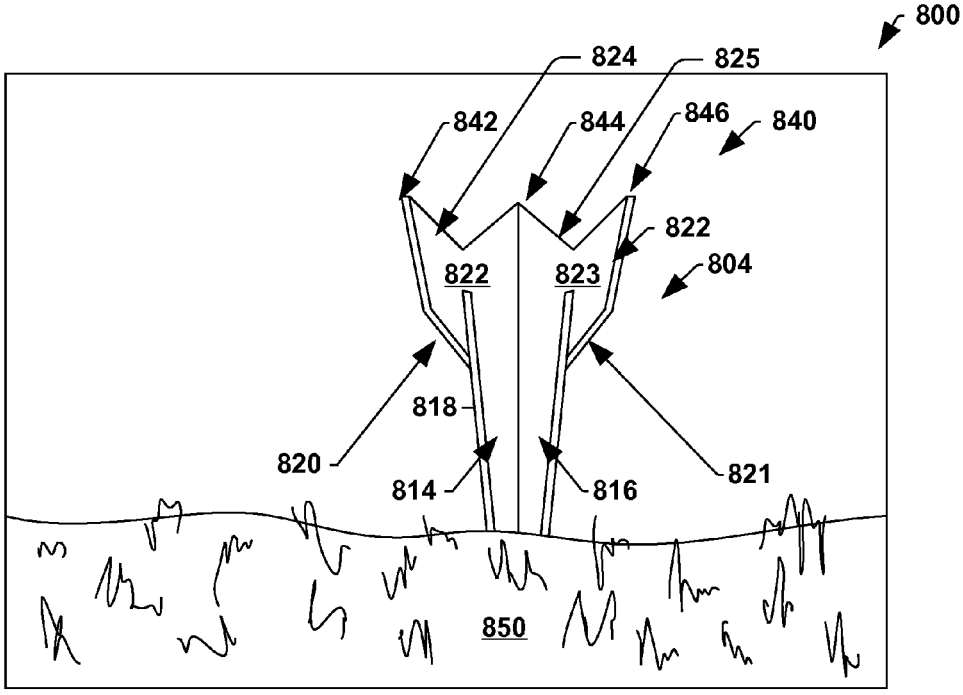
FIG. 8 is a perspective view illustrating yet another embodiment of an exemplary tee element 800 illustrated in accordance with an aspect of the present invention.

FIGS. 7 and 8 illustrate yet another embodiment of the present invention wherein a card stock 700 (FIG. 7) is configured with tee elements 704. FIG. 7 is an illustration of each of the tee elements 704 is configured with a tee element first side 714 and a tee element second side 716 and is configured to fold along a defined folding line 718. Each of the tee elements 704 is configured with a first side slot 720 and a second side slot 721, wherein the slots, 720 and 721 can be cut entirely through the card stock 702 or perforated in the card stock, for example.

The tee elements 704 are configured with a first side crown area 722 and a second side crown area 723 that can be reconfigured to hold a stationary golf ball on a crown area first side top edge 724 and crown area second side top edge 725. The stationary golf ball is held on a first point 742, a second point 744 and a third point 746, for example.

A tee element 802 is illustrated in the photo 800 shown as FIG. 8, wherein a tee element 802 is configured to hold a golf ball (not shown) in a stationary position. The tee element 802 is configured with a tee element first side 814 and a tee element second side 816 and is shown folded along a defined folding line 818. The tee element 802 is configured with a first side slot 820 and a second side slot 821, wherein the slots, 820 and 821 can be cut entirely through a card stock or perforated in the card stock, for example.

The tee element 802 is configured with a first side crown area 822 and a second side crown area 823 that can be reconfigured to hold a stationary golf ball on a crown area first side top edge 824 and a crown area second side top edge 825. The stationary golf ball can be held on three points, for example on a first point 842, a second point 844 and a third point 846, with the points, 842, 844 and 846, as illustrated. The tee element 802 is shown with a tee element tip 748 (FIG. 7) inserted into a ground surface 850. The tip 748 can take various shapes, pointed, rounded, triangular, and the like.

FIG. 9A illustrates a small dovetail component 900 and a large dovetail component 950 of a simplified two prong dovetail component 902 of an exemplary four point dovetail tee assembly 1000 (FIG. 10), such as may be used as an improved structural tee assembly, in accordance with the present invention. The small dovetail component 902 comprises a first prong 962, a second prong 964 and a first interconnecting slot 966. FIG. 9B illustrates a photo 950 of a two prong elongated dovetail component 952 that comprises an elongated dovetail component tip 958, a second interconnecting slot 960. The two prong elongated dovetail component 952 is configured with a third prong 968, a forth prong 970 and an elongated dovetail component body 972.

FIG. 10 illustrates the four prong assembled tee 1000 that is configured with a simplified two prong dovetail component 902 interlocked with a two prong elongated dovetail component 952. A two prong dovetail component first interconnecting slot 966 (FIG. 9A) is configured to engage and non-fixedly attach with an elongated dovetail component second interconnecting slot 960 (FIG. 9B), as illustrated in FIG. 10.

Figure 11:
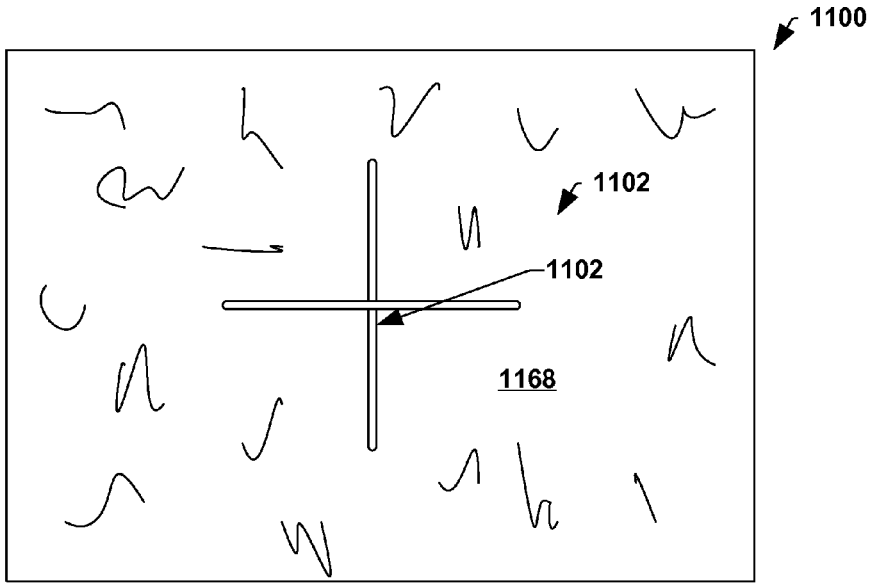
FIGS. 11-12 illustrate figures of an assembled dovetail tee assembly inserted into a flexible material to simulate the tee inserted into the ground in accordance with an aspect of the present invention.
Figure 12:
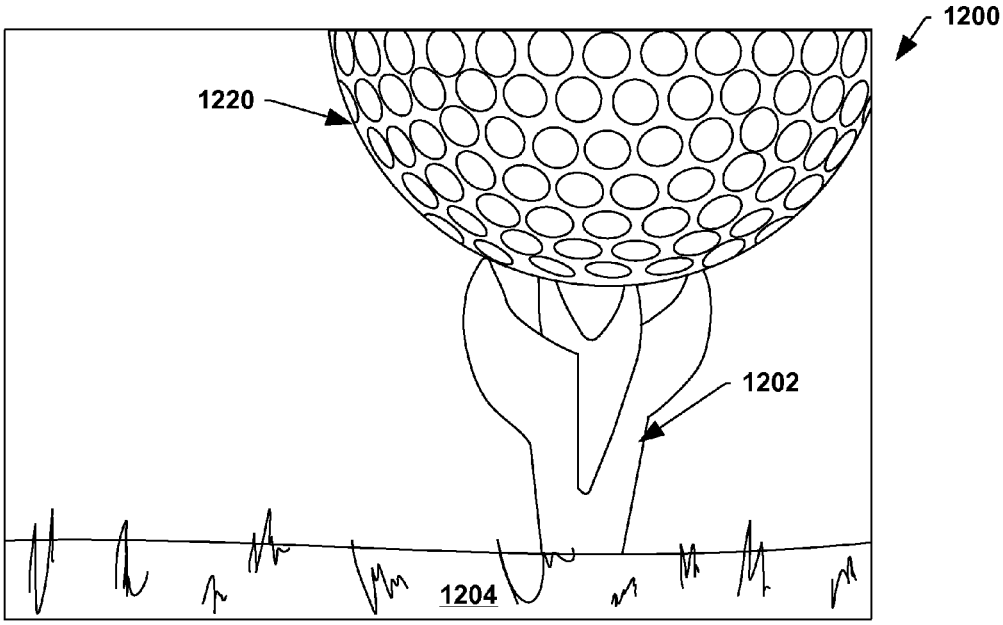

FIG. 11 illustrates a top view photograph 1100 of a four point dovetail tee assembly 1102 inserted into a ground surface 1168. A stationary golf ball 1220 is illustrated in FIG. 12 mounted on a four point dovetail tee assembly 1202 inserted in the ground 1204.

Figure 13:
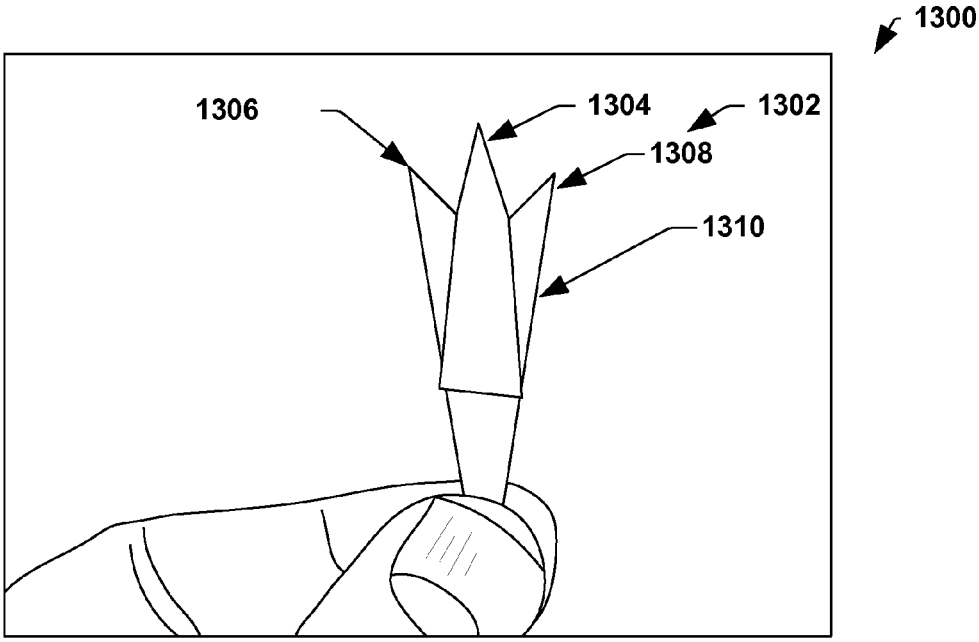
FIGS. 13-16 illustrate figures of a three prong tee assembly in various configurations in accordance with one or more aspects of the present invention.
Figure 14:
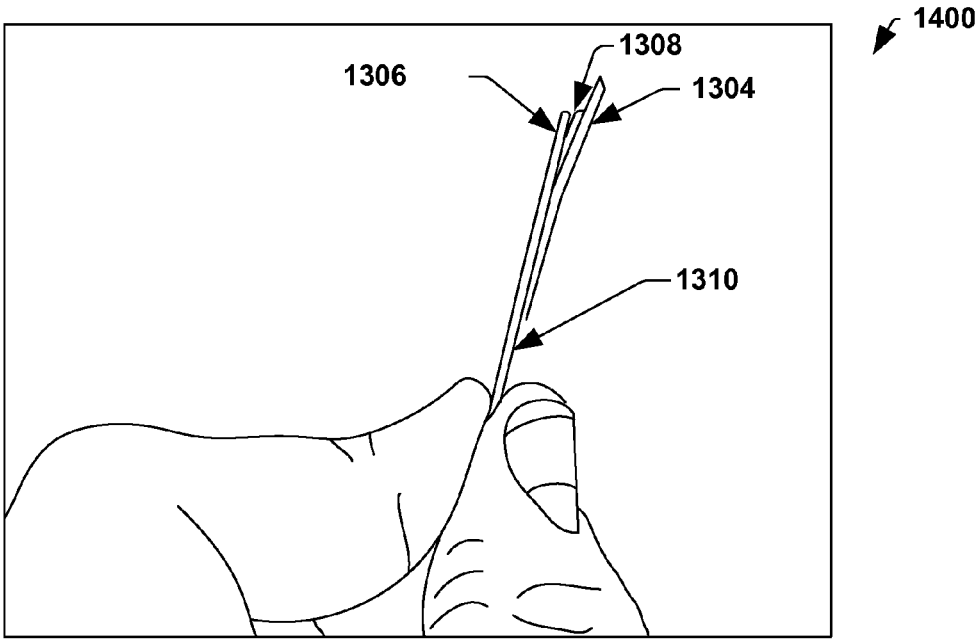

FIGS. 13-16 illustrate yet another embodiment of the present invention 1300, 1400, 1500 and 1600. FIG. 13 illustrates a three prong tee 1302 that can, for example be molded from one piece of plastic or a third prong 1304 can be added as illustrated in FIG. 13 of this embodiment as a secondary operation. The third prong 1304 can comprise bendable metal, plastic, biodegradable plastic, and the like. A first prong 1306 and second prong 1308 as illustrated in FIG. 14 are formed as an integrated two prong tee component 1310.

Figure 15:
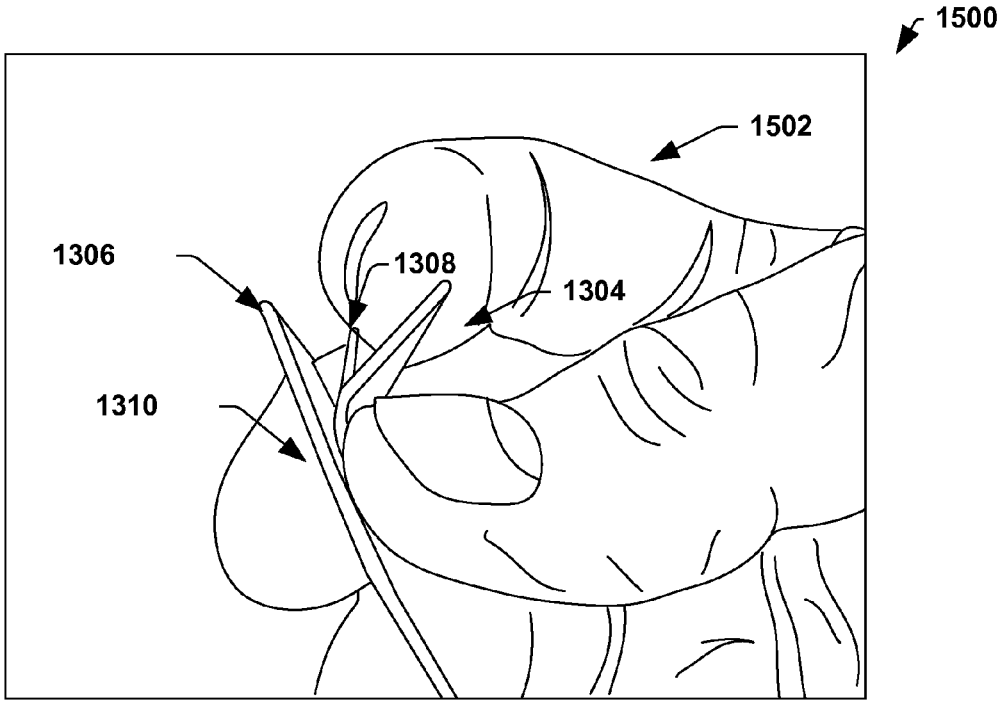
Figure 16:
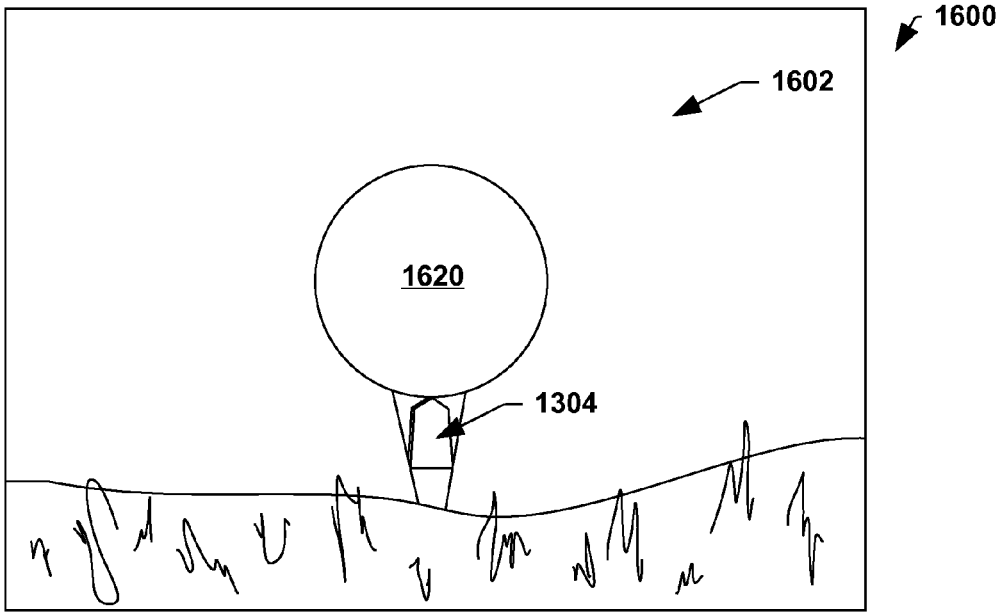

FIG. 15 illustrates the three prong tee 1302 configured to allow the third prong 1304 to be adjusted away from the first prong 1306 and the second prong 1308 so that the three prong tee 1302 can support a stationary golf ball 620, as illustrated in FIG. 16. The golf ball 1620 is supported on the three prongs shown in FIGS. 15, 1304, 1306 and 1308, respectively.

Figure 17:
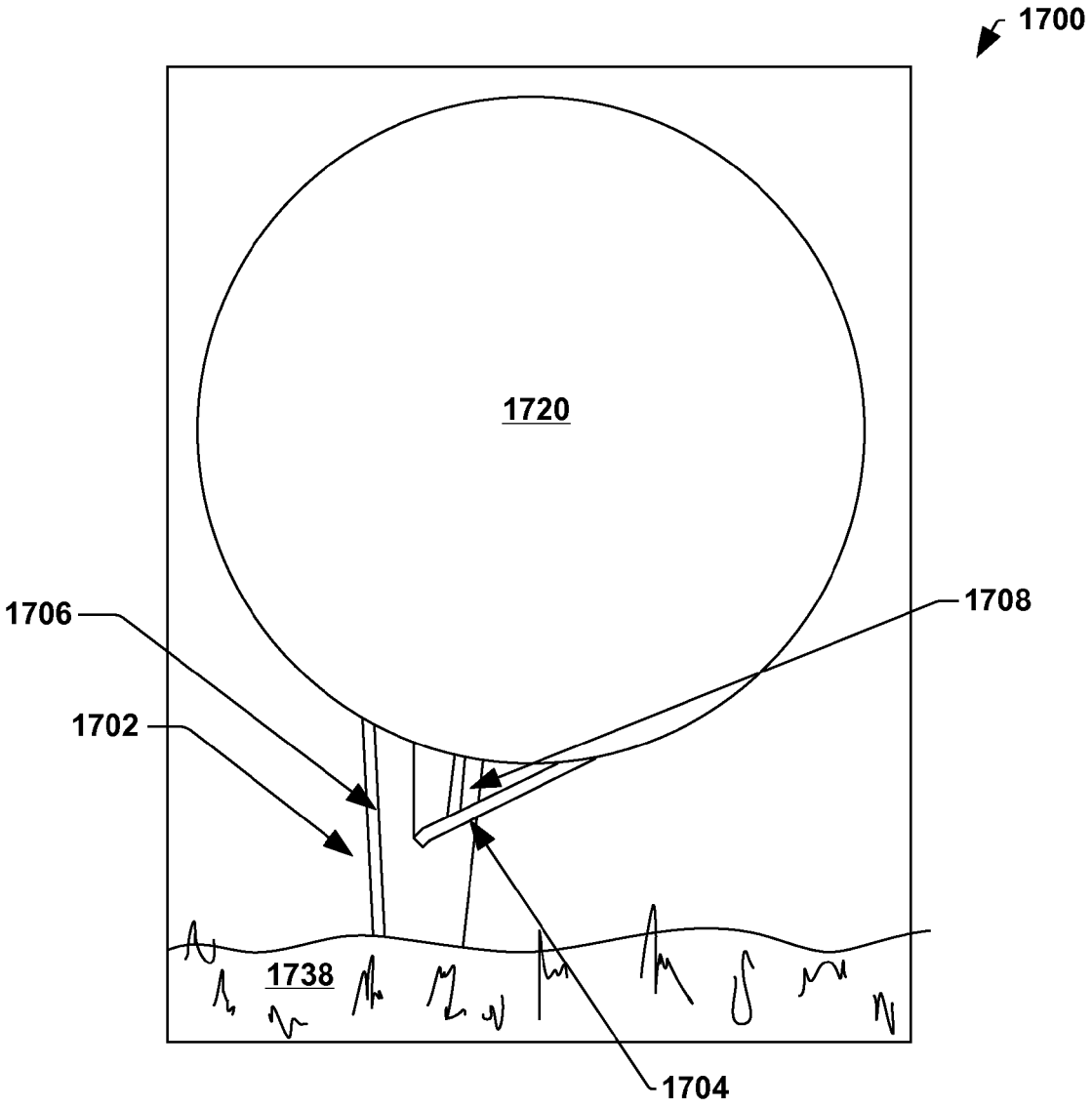
FIG. 17 illustrates yet another embodiment of a three prong tee holding a stationary golf ball according to the present invention.

In another embodiment as illustrated in FIG. 17, the card stock can be manufactured comprising stamped, molded, or the like, into a contiguous three prong tee 1702, as illustrated in FIG. 17 with a third prong 1704 integrated into and a contiguous part of the three prong tee 1702 and the third prong 1704 is not affixed utilizing a secondary operation comprising, e.g., gluing, molding, etc. FIG. 17 illustrates the three prong tee 1702, with the third prong 1704 bent outward when the tee 1702 is removed from the retaining card, for example. The center or third prong 1704, as illustrated in FIG. 17 is longer than the first and second prongs, 1706 and 1708, respectively. The tee 1702 is shown as it would be inserted into a ground surface 1738.

Figure 18:
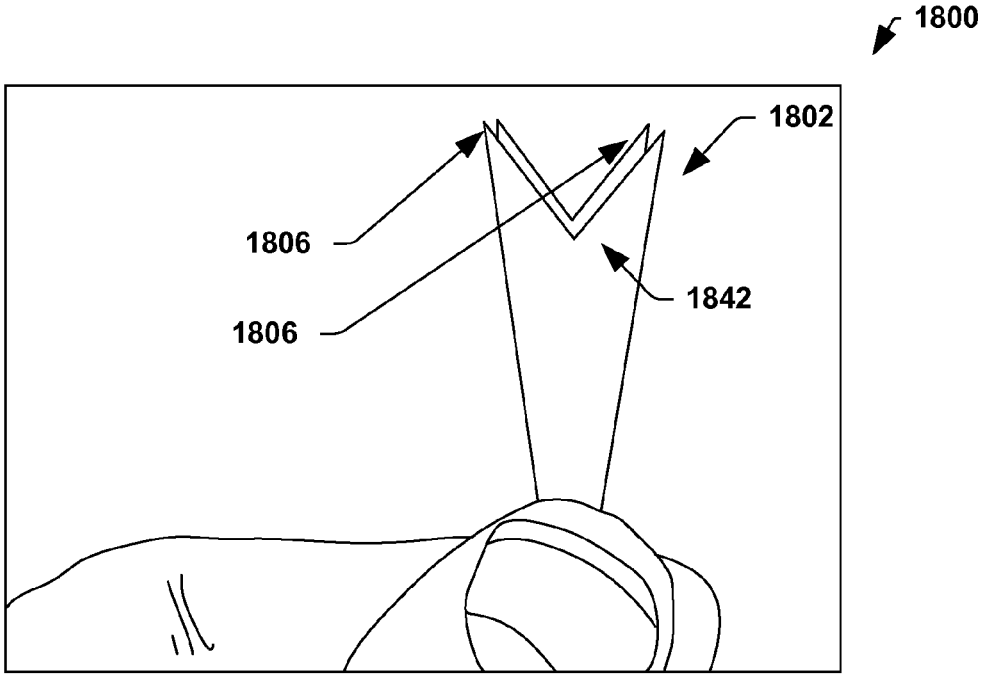
FIGS. 18-21 illustrates figures of a four prong tee assembly in various configurations in accordance with one or more aspects of the present invention.
Figure 19:
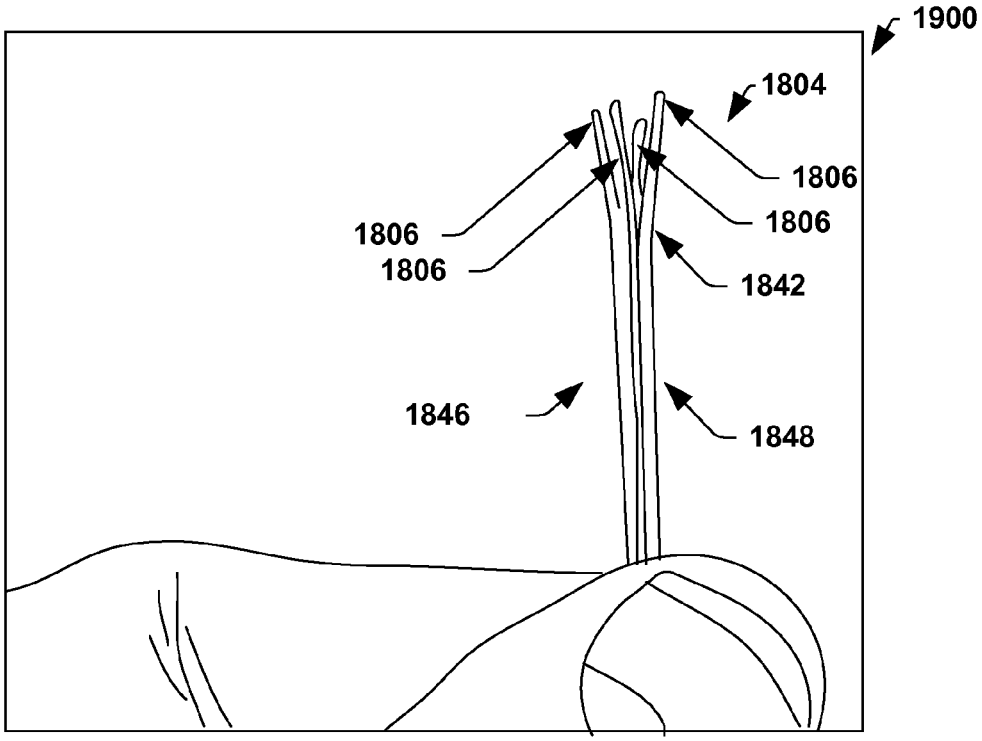

FIGS. 18 and 19 illustrate yet another embodiment of the present invention 1800 and 1900 involving a four prong tee 1804 such as may be inserted into a ground surface for holding a stationary golf ball in accordance with one or more aspects of the present invention. FIGS. 18 and 19 are perspective views of the four prong tee 1804, in accordance with one or more aspects of the present invention.

Figure 20:
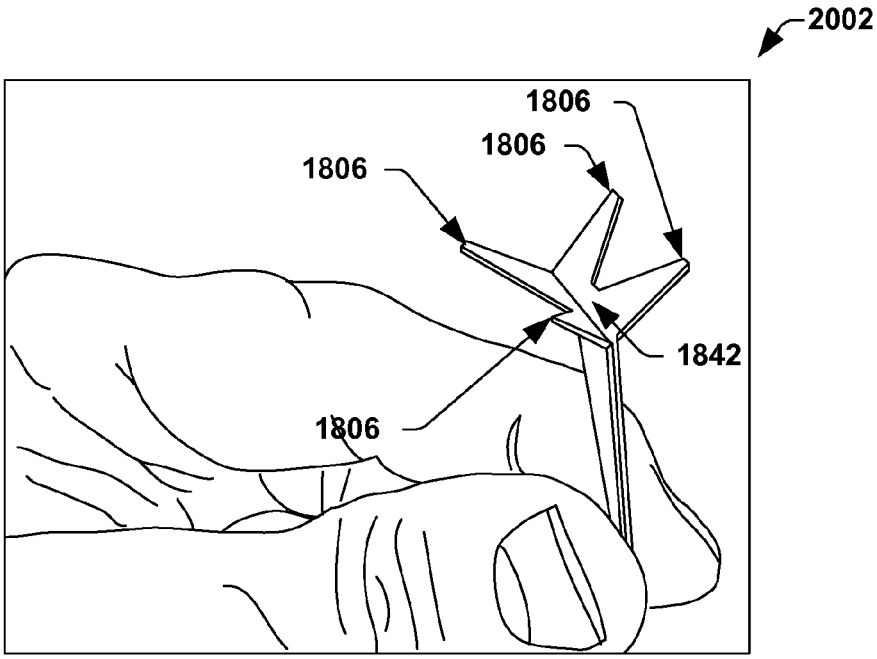
Figure 21:
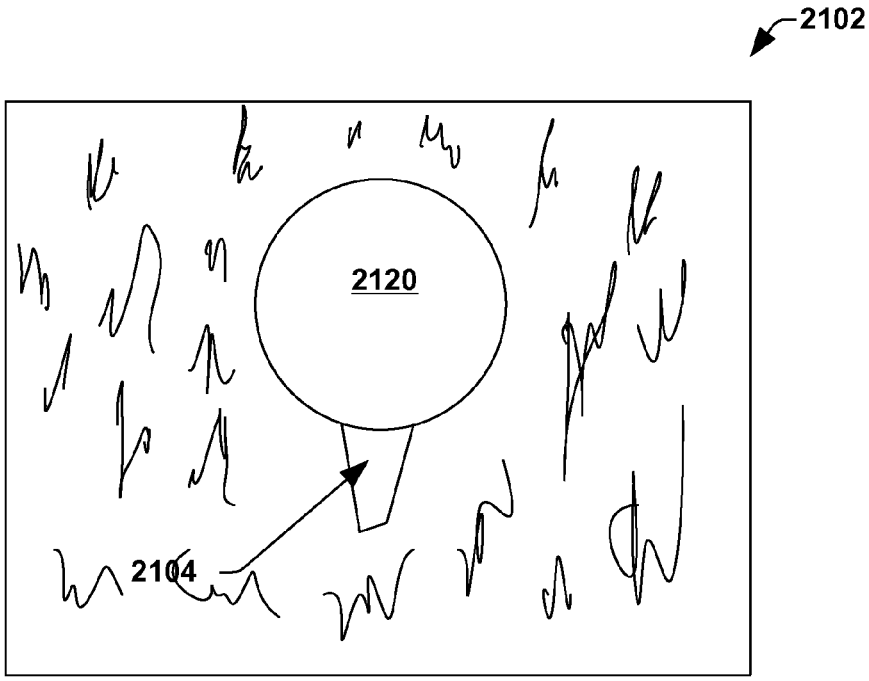

The four prong tee 1804 in the present embodiment 1800 comprises two pre-stamped cards, for example, glued or adhered to each other up to a tee head base. This allows a tee head comprising a first two prong section 1946 and a second two prong section 1948 to be opened like a butterfly, as illustrated in FIG. 20. In FIG. 21 a stationary golf ball 2120 can be placed on the four prongs 1806 (FIG. 18) with the center of gravity of the golf ball 2120 positioned over a four prong tee assembly 2104.

Figure 22:
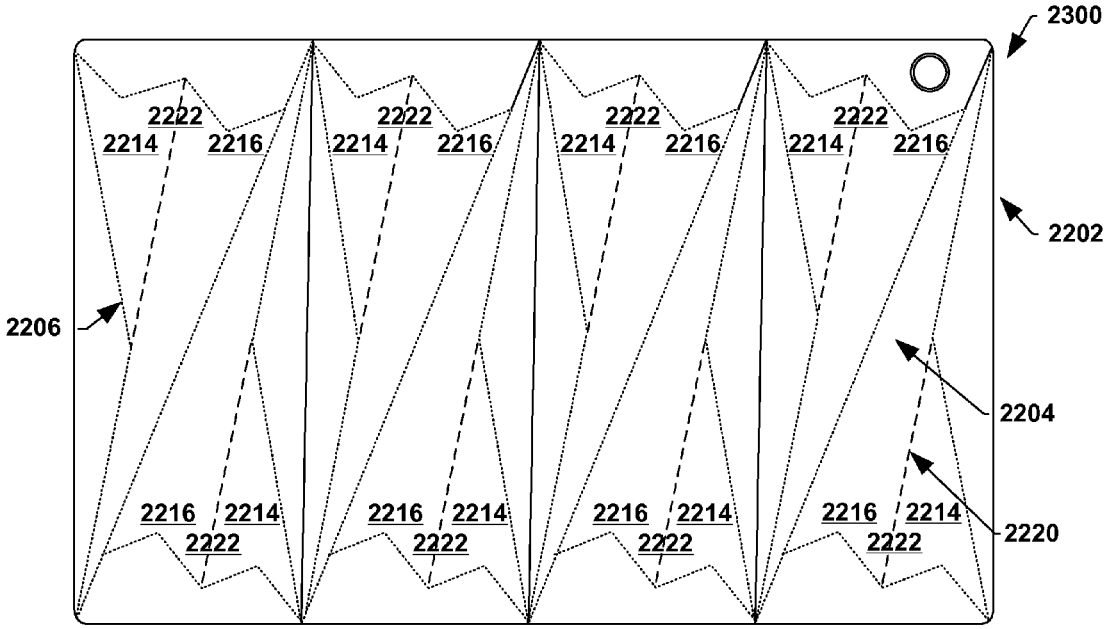
FIGS. 22, 23A and 23B illustrate figures of yet another four prong tee assembly in various configurations in accordance with one or more aspects of the present invention.
Figure 23A:
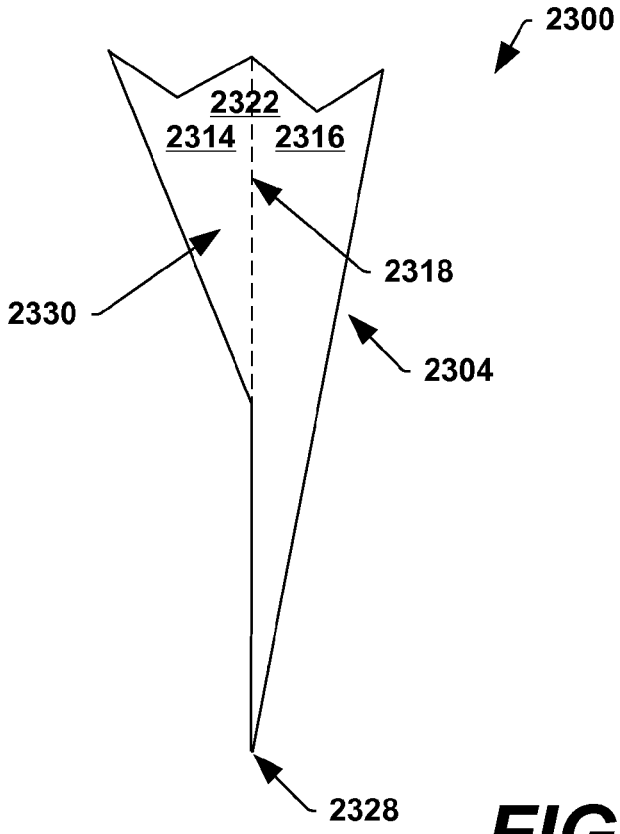
Figure 23B:
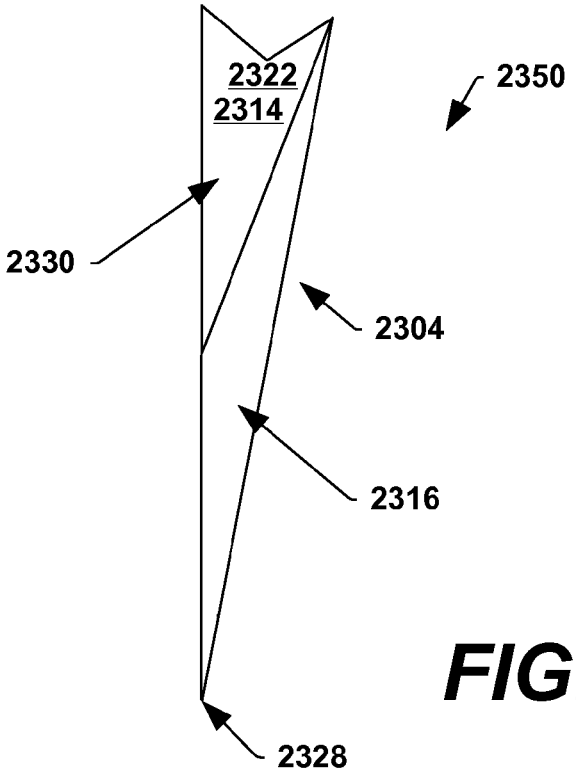

FIGS. 22, 23A and 23B illustrate an embodiment of an exemplary golf tee system 2200 used in accordance with at least one aspect of the present invention. FIGS. 22 and 23A illustrate several advantages of the present invention, the golf tee system 2200. The golf tee system 2200 comprises a card stock 2202 with at least one tee element 2204 non-fixedly attached to the card stock 2202 and configured to be removable from the card stock 2202 by bending the at least one tee element 2204 along a defined break line 2206 until the break line 2206 holding the at least one tee element 2204 to the card stock 2202 is broken. The at least one tee element 2204 can be bent and/or folded into a structural shape by bending the at least one tee element 2204 along a defined bend line 2218. The defined break line 2206 and/or the defined bend line 2220 can be formed by a laser, laser cutting or die cutting perforations in the card stock 2202 or creasing the card stock 2202, for example. The techniques of forming the defined bend line 2220 and/or the defined break line 2206 in the card stock 2202 are well known by those of ordinary skill in the art. In one embodiment, the card stock 2202 can take the shape of a credit card, however various other shapes can be used such as pinwheels, long strips of tees, and tees on a key ring. In this embodiment the at least one tee element 2204 is configured to form a crown area 2222 of the at least one tee element 2204. The crown area 2222 is approximately the area in close proximity to the top of the at least one tee element 2204, for example.

The card stock 2202 shown in FIG. 22 is shown with a colored graphic on the front face. The cardstock 2202 can be printed with artwork and/or lettering on one or both sides of the card stock 2202. The artwork and/or lettering can be black and white, grayscale or colored. A ball marker 2266 can optionally be made in the card stock 2202 for marking a golf ball, and the like.

Illustrated in FIG. 23A and FIG. 23B is a tee element 2304 comprises a tee element first side 2314 and a tee element second side 2316 configured on opposite sides of a defined bend line 2318 from the top of a crown area 2322 to an end of the first side 2328. The tee element first side 2214 is smaller than the second side 2316. The tee element 2304 in FIG. 23B is shown folded along a defined bend line 2318 so that the tee element first side 2314 and the tee element second side 2316 come in close proximity to each other, at a location away from the defined bend line 2318. A body portion 2330 of the tee element 2304 is approximately located in the center of the tee element 2304. A ground penetration point 2328 is located approximately at a bottom of the tee element 2304.

Figure 24:
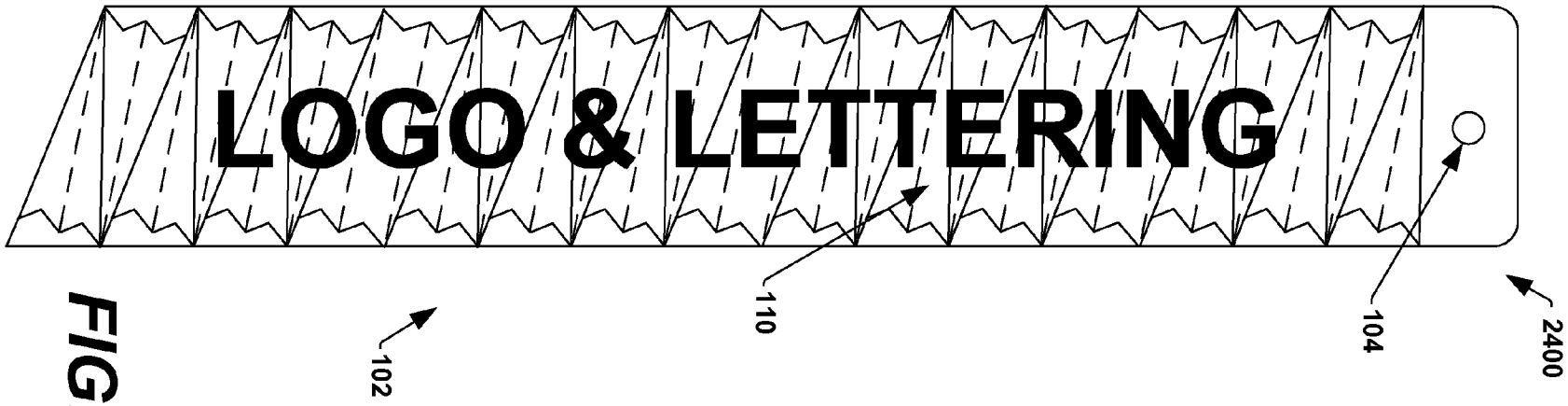
FIG. 24 illustrates a strip of tees in accordance with yet another aspect of the present invention.

A card stock strip 2402 shown in FIG. 24 is illustrated with a logo and lettering printed on one side the card stock strip 2402, however the strip 2402 can be printed without artwork and/or lettering. In addition, the card stock strip 2402 can be printed with artwork and/or letter on both sides of the card stock 2402. The artwork and/or lettering can be black and white, grayscale or colored. A through hole 2426 can optionally be made in the card stock strip 1102 for a key chain, a strap and the like, that can be attached to a golf bag, for example. The strip 1102 comprises tees 2420 similar to those shown in FIG. 1, for example. Even though the tees 2420 are shown in a symmetric manner where the tees have identical shapes, however the tees on a card stock can be dissimilar in shape, in the way in which they are assembled and the like. In addition the card stock can be formed in various shapes, for example animal shapes, non-symmetric shapes, etc.

Figure 25:
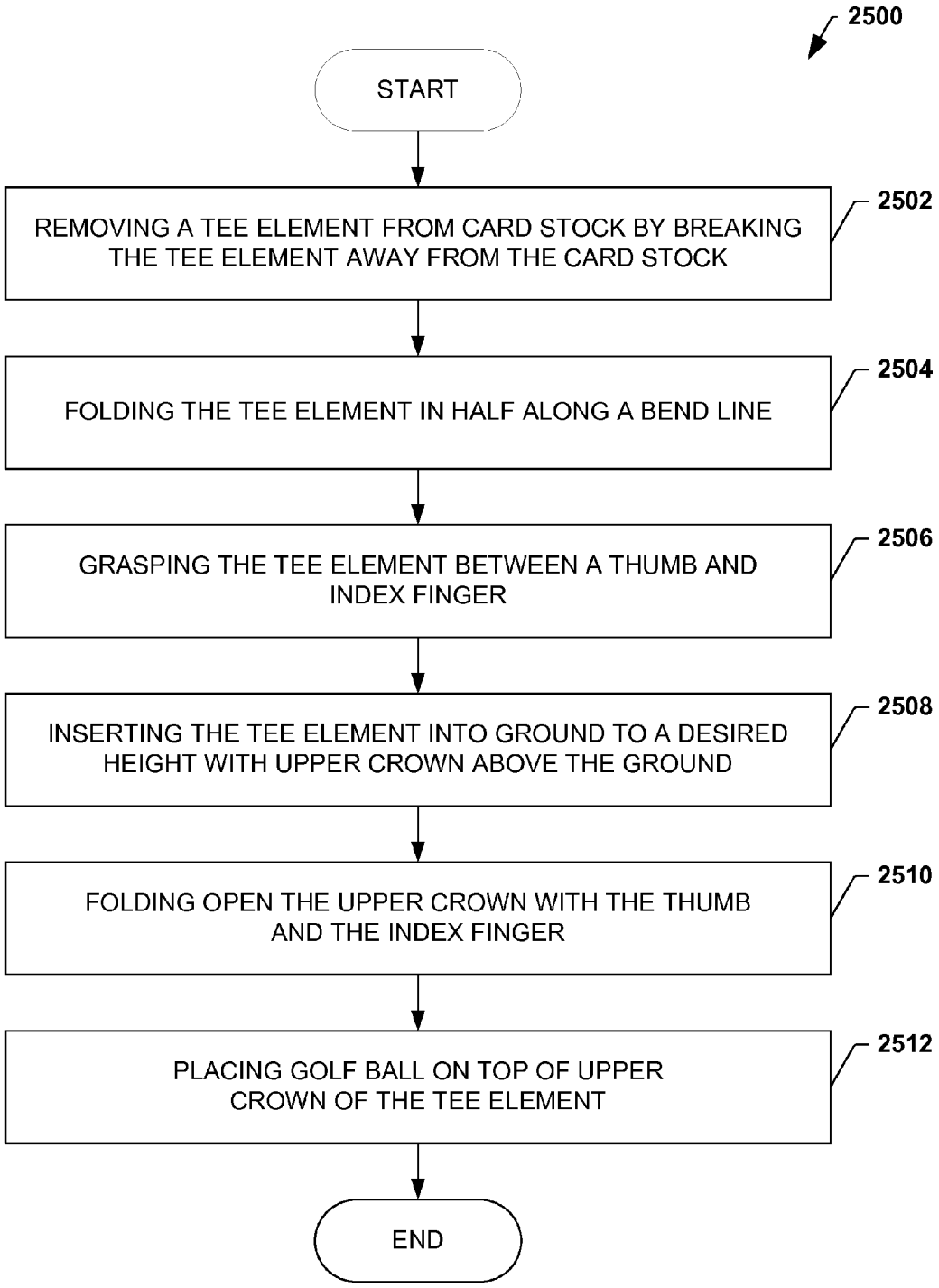
FIG. 25 illustrates a method of forming a structural tee element in accordance with one or more aspects of the present invention.

FIG. 25 is a flow diagram of a method 2500 of forming a golf ball tee in accordance with an aspect of the present invention. The method 2500 can be performed as part of a placing a tee to hold a stationary golf ball. In addition, the method makes reference to FIGS. 1-6, for example.

The method 2500 begins at block 2502, wherein at least one tee element 104 (FIG. 1) is removed from a card stock 102 (FIG. 1) by snapping the at least one tee element 104 off of and out of the card stock 102. The desired materials for the card stock 102 can include, for example, polyvinyl chloride acetate, polyvinyl chloride, celluloid, corn based material, acrylonitrile butadiene styrene, polyethylene terephthalate, polycarbonate, corn-based polylactic acid, petroleum-based plastics, bioplastics, teslin, and the like. In addition, the tee can be made from any plastic, metal, biodegradable material and wood, for example capable of holding a golf ball.

At 2504, the at least one tee element 104 is folded completely in half as illustrated in FIG. 3 by folding the at least one tee element 104 along a defined bend line 118 (FIG. 2). The defined bend line 118 can be formed by a laser, laser cutting, die cutting perforations in the card stock 102 or scoring the card stock 102, for example.

At 2506, the folded tee 300 can be grasped at a body portion 130 of the at least one tee element 104 by tightly squeezing the body portion 130 between a thumb and index finger, for example. The body portion 130 can be grasped with a golfer's left or right hand.

The at least one tee element 104 can be inserted into a ground surface 438 (FIG. 4) and can be adjusted to a desired height of the at least one tee element 104 above the ground surface 438. When the desired height has been obtained the golfer can open or spread apart a crown area first side 422 and a crown area second side with the thumb and index finger at 2510. The golf ball 640 (FIG. 6) can then be placed at 2512 on and supported by a crown area first side top edge 424 and a crown area second side top edge 425.

Although the invention has been illustrated and described with respect to one or more implementations, equivalent alterations and modifications will occur to others skilled in the art upon the reading and understanding of this specification and the annexed drawings. In particular regard to the various functions performed by the above described components (assemblies, devices, circuits, systems, etc.), the terms (including a reference to a "means") used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "including", "includes", "having", "has", "with", or variants thereof are used in either the detailed description and the claims, such terms are intended to be inclusive in a manner similar to the term "comprising."

What is claimed is:

1. A golf tee system comprising:

a card having a width, length, and a thickness, comprising at least one tee element configured to be removable from the card, the tee element comprising:

a first edge and a second edge, the first and second edges defining:

a ground engaging point at a first end of the tee element, and a ball engaging crown at a second end of the tee element, wherein at least one of the first edge and the second edge comprises a break-line used to disengage the tee element from the card;

a first bend line disposed along a bisecting line between the first end and the second end of the tee element; and a first side slot disposed at the first edge and extending partially toward the bisecting line, and a second side slot disposed at the second edge and extending partially toward the bisecting line, wherein respective first and second side slots are disposed through the thickness of the card and are configured to allow a top portion of the tee element to partially disengage from a bottom portion of the tee element; wherein the tee element comprises a first side wall defined by said first edge and said bisecting line, and a second side wall defined by said second edge and said bisecting line; and wherein the first side wall and the second side wall, when folded toward each other, at least partially define an inner cavity within a body portion of said tee element.

2. The golf tee system of claim 1, wherein the tee element is configured to be reconfigured into a golf ball holding device, wherein the bottom portion is configured to be inserted into a ground surface and the top portion is configured to allow a golf ball to rest on the top portion of the tee element above the ground surface.

3. The golf tee system of claim 1, wherein a folded upper crown of the top portion defines a ball receiving surface configured to engage and hold a golf ball above the ground surface.

4. The golf tee system of claim 1, wherein the card comprises one or more of polyvinyl chloride acetate, polyvinyl chloride, celluloid, com based material, acrylonitrile butadiene styrene, recyclable material containing inorganic filler, non-cellulose recyclable material, polyethylene terephthalate, polycarbonate, corn-based polylactic acid, petroleum-based plastics, and bioplastics.

5. The golf tee system of claim 1, wherein the card thickness comprises one of:

from one to seventy mils; and greater than seventy mils.

6. The golf tee system of claim 1, wherein the card width comprises one of:

less than or equal to two inches; and greater than two inches.

7. The golf tee system of claim 1, wherein the card stock length comprises one of:

less than three inches; and greater than three inches.

8. The golf tee system of claim 1, wherein the ball engaging crown comprises at least three ball engaging points.

9. The golf tee system of claim 1, wherein one or more of:

one or more break-lines disposed in the card are formed using one or more of a laser, a die, and cutting die; and one or more bend-lines disposed in the card are formed using one or more of a laser, a die, and cutting die.

10. The golf tee system of claim 1, wherein the material/card stock comprises one of no print, one printed side, and both printed sides.

11. The golf tee system of claim 1, wherein the tee element comprises material that provides less hitting resistance than a tee comprising one or more of: wood, plastic, and cardboard.

12. A golf tee system comprising:

a card having a width, length, and a thickness, comprising at least one tee element configured to be removable from the card, the tee element comprising:

a first edge and a second edge, the first and second edges defining:

a ground engaging point at a first end of the tee element, and a ball engaging crown at a second end of the tee element, wherein at least one of the first edge and the second edge comprises a break-line used to disengage the tee element from the card;

a first bend line disposed along a bisecting line between the first end and the second end of the tee element;

a first side slot disposed at the first edge and extending partially toward the bisecting line, and a second side slot disposed at the second edge and extending partially toward the bisecting line, wherein respective first and second side slots are disposed through the thickness of the card and are configured to allow a top portion of the tee element to partially disengage from a bottom portion of the tee element;

a second bend line disposed in the top portion between a first crown notch and an endpoint of the first side slot, and configured to allow a first side of the ball engaging crown to be bent away from the bottom portion of the tee element to form the ball engaging crown; and a third bend line disposed in the top portion between a second crown notch and an endpoint of the second side slot, and configured to allow a second side of the ball engaging crown to be bent away from the bottom portion of the tee element to form the ball engaging crown;

wherein the tee element is configured to be reconfigured into a golf ball holding device, wherein the bottom portion is configured to be inserted into a ground surface and the top portion is configured to allow a golf ball to rest above the ground on the ball engaging crown; and wherein the tee element comprises material that provides less hitting resistance than a tee comprising one or more of: wood, plastic, and cardboard.

* * * * *